US007055595B2

(12) United States Patent
Mack et al.

(10) Patent No.: US 7,055,595 B2
(45) Date of Patent: Jun. 6, 2006

(54) ELECTRICAL SUBMERSIBLE PUMP ACTUATED PACKER

(75) Inventors: John J. Mack, Tulsa, OK (US); Brown L. Wilson, Tulsa, OK (US); Donn J. Brown, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 36 days.

(21) Appl. No.: 10/817,065

(22) Filed: Apr. 2, 2004

(65) Prior Publication Data

US 2005/0217860 A1 Oct. 6, 2005

(51) Int. Cl.
*E21B 43/00* (2006.01)
*E21B 33/127* (2006.01)

(52) U.S. Cl. ..... 166/106; 166/387; 166/187; 166/372

(58) Field of Classification Search ..... 166/106, 166/187, 387, 133, 188, 372
See application file for complete search history.

(56) References Cited

U.S. PATENT DOCUMENTS

| | | | | |
|---|---|---|---|---|
| 58,469 | A | 10/1866 | Parker | |
| 2,506,359 | A | 5/1950 | Haslam | |
| 2,783,028 | A | 2/1957 | Jamison, Jr. | |
| 4,467,865 | A | 8/1984 | Hardymon | |
| 4,703,936 | A | 11/1987 | Clark, Jr. et al. | |
| 5,320,182 | A * | 6/1994 | Mendez | 166/387 |
| 5,404,946 | A | 4/1995 | Hess | |
| 5,845,709 | A | 12/1998 | Mack et al. | |
| 6,668,925 | B1 | 12/2003 | Shaw et al. | |
| 2001/0037881 | A1 * | 11/2001 | Brecheisen | 166/106 |

* cited by examiner

*Primary Examiner*—David Bagnell
*Assistant Examiner*—Giovanna M. Collins
(74) *Attorney, Agent, or Firm*—Bracewell & Giuliani LLP

(57) ABSTRACT

A centrifugal pump assembly for a well is lowered into the well on a string of tubing. A packer mounts to the pump assembly below an intake of the pump and is lowered in with the pump assembly. The packer is radially expansible to seal against the casing in the well. A conduit leads from the pump assembly to the packer for diverting a portion of the well fluid being pumped through the pump assembly. This pressurized fluid causes the packer to expand and seal against casing.

19 Claims, 2 Drawing Sheets

Fig. 1
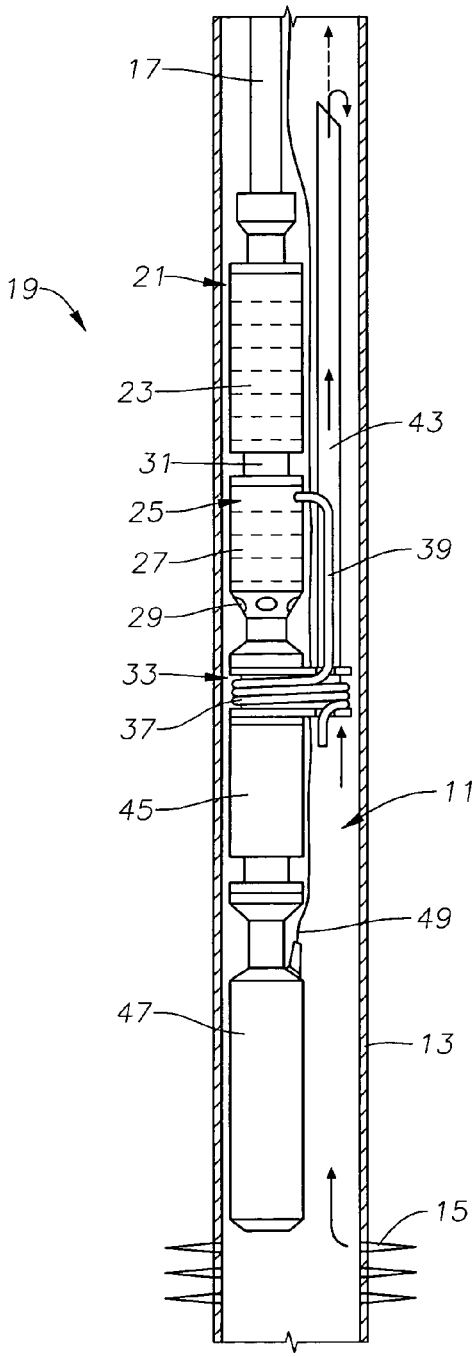
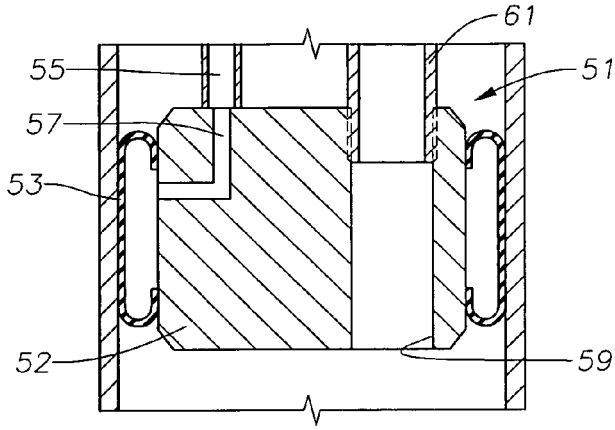
Fig. 4

ELECTRICAL SUBMERSIBLE PUMP ACTUATED PACKER

FIELD OF THE INVENTION

This invention relates in general to well pumps, and in particular to an electrical submersible pump assembly with a packer that actuates in response to pump pressure.

BACKGROUND OF THE INVENTION

One type of electrical submersible pump assembly for oil wells includes a centrifugal pump that is coupled to an electrical motor. The pump has a large number of stages of impellers and diffusers. Normally, the pump assembly is lowered into the well on a string of tubing and, during operation, discharges the well fluid up through the tubing to the surface. The well fluid flows through perforations, past the electrical motor for cooling, and then enters the intake of the pump.

Often the well fluid is made up of water, oil and gas. Gas entrained in the well fluid may have a damaging effect on the ability of the pump to pump the well fluid. Significant amounts of gas or a gas slug can cause the pump to gas lock. A number of methods have been developed to re-route the gas so that it passes the pump intake. In one technique, a gas separator is installed in the pump assembly below the intake and above the motor for separating gas before entering the pump. A common type of gas separator has a rotating vane that separates gas from liquid by centrifugal force. Normally the gas flows to the annulus in the casing, and the remaining liquid portion of the well fluid flows up into the intake of the pump.

A number of other systems have been proposed to reroute the well fluid so that the gas passes the pump intake. In some techniques, a packer is set in the casing to isolate the separated gas from the well fluid being drawn into the intake. Usually, the packer is set in advance by a conventional method, then the pump assembly is lowered into the well, and a stinger on the lower end stabs into the packer.

SUMMARY OF THE INVENTION

In this invention, a packer is mounted to and lowered into the well with the pump assembly. The packer is radially expansible from a retracted position to an expanded position. A conduit leads from the pump assembly to the packer for delivering a portion of the well fluid flowing through the submersible pump assembly while the pump is operating. This diverted portion of the well fluid flows to the packer and causes the packer to move to the expanded position. Shutting off the pump causes the packer to return to the retracted position.

Preferably, the packer is located below an intake of the pump assembly. A bypass passage extends through the packer. A riser extends upward from the bypass passage and has an upper end above an intake of the pump assembly. The well fluid flowing from the perforations flows up the bypass passage and the riser tube, then down to the intake of the pump. As the well fluid turns from the upward flowing direction to the downward flowing direction, gas separates from the liquid by gravity separation.

BRIEF DESCRIPTION OF DRAWINGS

FIG. 1 is an elevational view of a submersible pump assembly having a packer constructed in accordance with the invention.

FIG. 4 is a partial sectional view of an alternate embodiment of a packer in accordance with this invention.

DETAILED DESCRIPTION OF THE INVENTION

Figure 2:
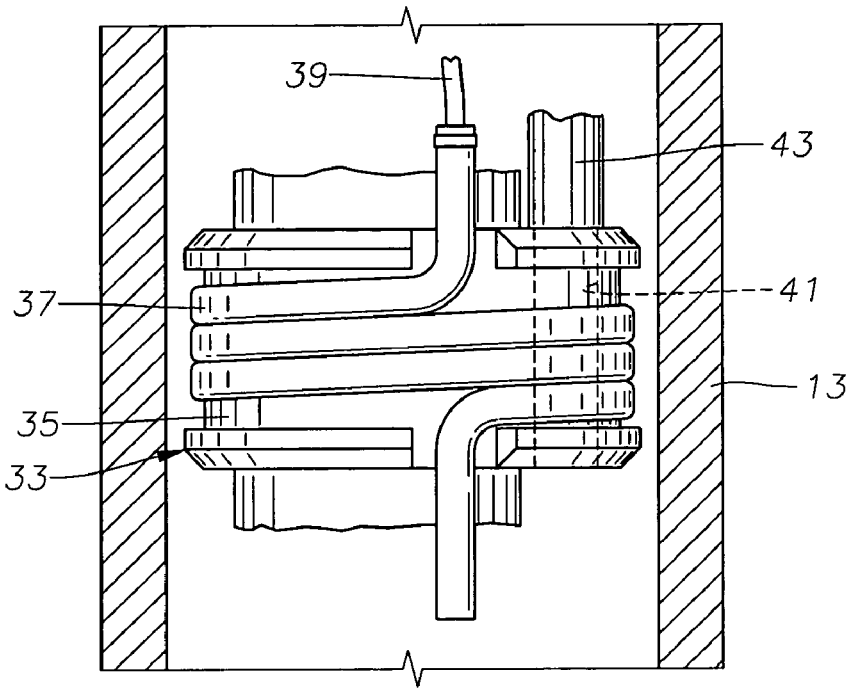
FIG. 2 is an enlarged elevational view of the packer of FIG. 1, shown in a retracted position.

Referring to FIG. 1, well 11 has a casing 13 that is cemented in place. Perforations 15 in casing 13 admit well fluid into casing 13. A string of production tubing 17 is lowered into casing 13. Tubing 17 may be made up of individual sections of pipe screwed together, or it may comprise continuous coiled tubing.

An electrical submersible pump assembly 19 is suspended on the lower end of tubing 17. Pump assembly 19 in this embodiment includes an upper pump 21. Upper pump 21 is preferably a conventional centrifugal pump having a number of pump stages 23, shown schematically by the dotted lines. Each pump stage 23 comprises an impeller and a diffuser (not shown). Alternately, upper pump 21 could comprise a different type of pump, such as a progressing cavity pump.

A lower pump 25 is mounted below upper pump 21. Lower pump 25 is also conventional, and has at least one stage 27 having an impeller and a diffuser. Upper pump 21 preferably has many more stages 23 than the stages 27 of lower pump 25. Lower pump 25 has an intake 29 to admit well fluid. A tandem connector 31 connects the discharge of lower pump 25 to the intake of upper pump 21. Well fluid flowing into lower pump intake 29 will thus pass through lower pump 25 and into upper pump 21.

Lower pump 25 and upper pump 21 could alternately be a single integral pump, with lower pump 25 merely comprising a lower portion of upper pump 21. Furthermore, lower pump 25 could be a rotary gas separator with an inducer stage. An inducer stage of a rotary gas separator is actually a pump stage, thus this type of gas separator, if used, would not only separate liquid and gas by centrifugal force, but would also increase pressure due to the inducer stage.

A packer 33 is mounted to pump assembly 19 below intake 29. Packer 33 in one embodiment has a packer body 35 as shown in FIG. 2. Packer body 35 could be an integral portion of the lower end of lower pump 25. An elastomeric hose 37 is wrapped with multiple turns around body 35. Hose 37 is inflatable and is shown in the contracted position in FIG. 2. The lower end of hose 37 is sealed, and the upper end connects to a conduit 39. Conduit 39 leads to a portion of pump assembly 19 for supplying well fluid under an increased pressure over the hydrostatic pressure surrounding hose 37.

Figure 3:
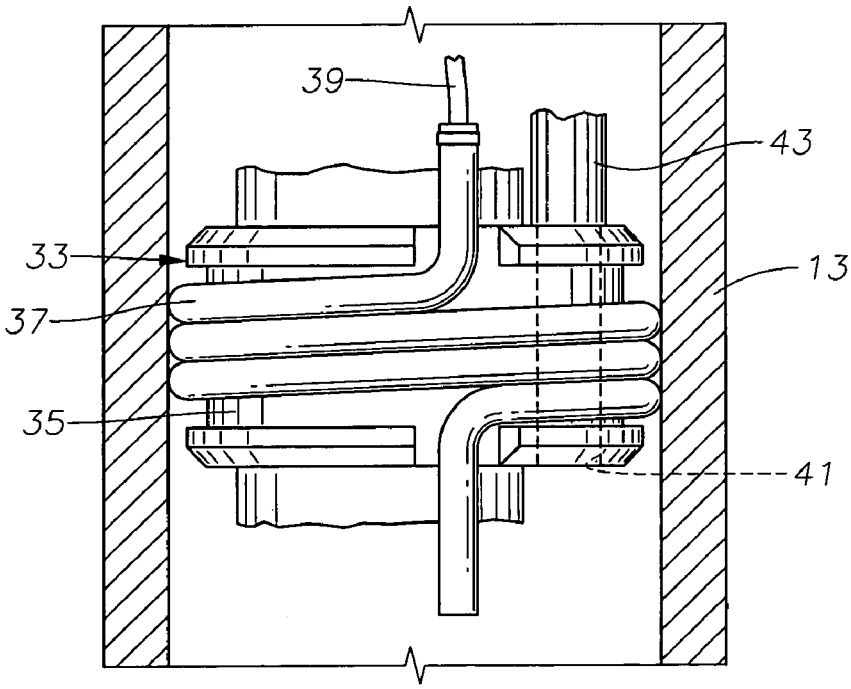
FIG. 3 is an enlarged elevational view of the packer of FIG. 1, shown in an expanded position.

In the preferred embodiment, as shown in FIG. 1, conduit 39 taps into the uppermost stage 27 of lower pump 25. The uppermost stage 27 is actually an intermediate stage between the lowest stage 27 in lower pump 25 and the highest stage 23 in upper pump 21. The pressure of the well fluid flowing through lower pump 25 and upper pump 21 increases with each stage 27 and 23. Consequently, the pressure at the uppermost stage 27 of pump 25 will be elevated above the intake 29 pressure, which is approximately the hydrostatic pressure at packer 33, and be below the discharge pressure of upper pump 21. This increased pressure causes hose 37 to inflate and seal against casing 13 as shown in FIG. 3.

Packer body 35 preferably has a bypass passage 41 that extends through it from its lower end to its upper end. Bypass passage 41 is preferably located in a laterally protruding portion of packer body 35, thus in this example, packer body 35 is eccentric. This laterally protruding portion extends farther outward from the outer diameter of the lower end of pump 25. A riser tube 43 extends into bypass passage 41 for allowing well fluid from perforations 15 (FIG. 1) to flow up riser tube 43.

As shown in FIG. 1, the upper end of riser tube 43 is spaced a considerable distance above pump intake 29. In the embodiment shown, the upper end of riser tube 43 is located above the upper end of upper pump 21. With packer 33 in the sealed position of FIG. 3, all of the well fluid flowing into intake 29 (FIG. 1) must first flow along the communication path of bypass passage 41 and riser tube 43, then back downward to intake 29, as indicated by the solid arrows. The dotted arrows indicate that a significant portion of the gas will separate from the liquid at the upper end of riser tube 43 and continue up casing 13.

Referring again to FIG. 1, pump assembly 19 has a conventional seal section 45 and an electrical motor 47. The upper end of seal section 45 connects to the lower end of packer body 35, and packer body 35 could be integrally formed on seal section 45. Motor 47 has a rotating shaft (not shown) that is coupled to a shaft in seal section 45. The shaft in seal section 45 extends through packer body 35 and couples to a shaft in lower pump 25 for driving lower pump 25. The shaft in lower pump 25 is coupled to a shaft in upper pump 21 for driving upper pump 21. Motor 47 and seal section 45 are filled with a dielectric lubricant. Seal section 45 has a movable barrier for communicating hydrostatic pressure to the lubricant. Having the lubricant at approximately hydrostatic pressure reduces pressure differential across the seal around the shaft of seal section 45. A power cable 49 extends alongside production tubing 17 to motor 47.

In the operation of the first embodiment, packer 33 is assembled with pump assembly 19 and lowered into the well on tubing 17. The operator supplies power to motor 47 to drive pumps 25 and 21. Well fluid flows into intake 29. For a short duration upon start up, some of the well fluid may be drawn upward from perforations 15 and some from the annulus surrounding pumping assembly 19 above packer 33. Pump stages 27 and 23 increase the pressure of the well fluid as it flows up pumps 25, 21 into tubing 17. A portion of the well fluid is diverted into conduit 39, which causes hose 37 to inflate, as shown in FIG. 3, and seal against casing 13. Once inflated, all of the well fluid from perforations 13 must flow up riser tube 43. Packer 33 will remain in the expanded position as long as pump assembly 19 is operating.

Most of the gas contained in the well fluid is separated by gravity at the upper end of riser tube 43. This reduces the quantity of gas flowing into intake 29, and particularly avoids large quantities of gas or gas slugs from entering intake 29. For a well producing moderate quantities of gas, it would not be necessary to employ a rotary gas separator.

FIG. 4 illustrates an alternate embodiment. Packer 51 has a body 52. An annular bladder 53 surrounds body 52. Conduit 55, which leads from lower pump 25 (FIG. 1), communicates with the interior of bladder 53. In the example shown, a passage 57 leads through body 52 from conduit 55 to the interior of bladder 53. The fluid pressure causes bladder 53 to expand to the sealing position shown.

Packer 51 also has a bypass passage 59. A riser tube 61 extends upward from passage 59 for delivering well fluid. Although not shown, packer 51 also has a central passage through which a shaft from seal section 45 extends, as in the first embodiment. Packer 51 operates in the same manner as first embodiment packer 33.

The invention has significant advantages. The packer is set without requiring any additional trips into the well. The packer is run on the same trip as the pump assembly. The packer seals to the casing only when required, which is when the pump assembly is operating. The packer releases each time the pump ceases to operate, thus requires no special tools or manipulation when pulling the pump for maintenance. The packer facilitates gas separation by using a riser tube to gravity separate the gas from the liquid at a point above the intake to the pump.

While the invention has been shown in only two of its forms, it should be apparent to those skilled in the art that it is not so limited but is susceptible to various changes without it departing from the scope of the invention.

We claim:

1. An apparatus for pumping a well, comprising:

a submersible pump assembly adapted to be lowered into the well, the pump assembly having a discharge on an upper end for pumping well fluid to the surface;

a packer mounted to the pump assembly below an intake of the pump assembly, the packer being radially expansible from a retracted position to an expanded position for sealingly engaging casing of the well;

a bypass passage through the packer for the passage of well fluid to the intake of the pump assembly; and a conduit leading from the pump assembly to the packer for delivering a portion of the well fluid flowing through the submersible pump assembly to the packer to move the packer to the expanded position in response to fluid pressure in the conduit created by the pump assembly.

2. The apparatus according to claim 1, further comprising:

a riser tube extending upward from the bypass passage and having an upper end above the intake of the pump assembly for flowing well fluid from below the packer out the riser tube and down to the intake of the pump assembly.

3. The apparatus according to claim 1, wherein the pump assembly comprises:

a centrifugal lower pump having at least one pump stage;

a centrifugal upper pump mounted in tandem with the lower pump and having a plurality of pump stages in excess of the lower pump; and wherein the conduit extends from an upper end portion of the lower pump for diverting a portion of the well fluid, flowing through the lower and upper pumps.

4. The apparatus according to claim 1, wherein the packer comprises an inflatable elastomeric element, and wherein the well fluid flowing from the conduit causes the elastomeric element to inflate.

5. The apparatus according to claim 1, wherein the packer comprises:

a central body;

an annular elastomeric bladder surrounding the body; and wherein an interior of the bladder is in fluid communication with the conduit.

6. The apparatus according to claim 1, wherein the pump assembly comprises:

a pump;

a motor located below and operatively connected with the pump for driving the pump; and wherein the packer is located between the motor and the pump.

7. An apparatus for pumping a well, comprising:

a submersible pump assembly adapted to be lowered into the well for pumping well fluid;

a packer mounted to the pump assembly, the packer being radially expansible from a retracted position to an expanded position for sealingly engaging casing of the well;

a conduit leading from the pump assembly to the packer for delivering a portion of the well fluid flowing through the submersible pump assembly to the packer to move the packer to the expanded position in response to fluid pressure in the conduit created by the pump assembly;

and wherein the pump assembly comprises a plurality of centrifugal pump stages, and wherein the conduit leads to the packer from an intermediate one of the stages between lower and upper ones of the stages.

8. An apparatus for pumping a well, comprising:

a submersible pump assembly adapted to be lowered into the well for pumping well fluid;

a packer mounted to the pump assembly, the packer being radially expansible from a retracted position to an expanded position for sealingly engaging casing of the well;

a conduit leading from the pump assembly to the packer for delivering a portion of the well fluid flowing through the submersible pump assembly to the packer to move the packer to the expanded position in response to fluid pressure in the conduit created by the pump assembly;

and wherein the packer comprises:

a central body; and an elastomeric hose wrapped around the body a plurality of turns, the hose being in fluid communication with the conduit and being radially expansible.

9. An apparatus for pumping a well, comprising:

a centrifugal pump assembly having an intake for receiving well fluid, the pump assembly adapted to be connected to a string of tubing for lowering the pump assembly into the well;

a packer mounted to the pump assembly below the intake, the packer being radially expansible from a retracted position to an expanded position for sealingly engaging casing of the well;

a conduit leading from the pump assembly above the intake of the pump assembly to the packer for diverting a portion of the well fluid flowing through the pump assembly to the packer to move the packer to the expanded position in response to fluid pressure in the conduit created by the pump assembly;

a bypass passage extending through the packer; and a riser tube extending upward from the bypass passage and having an upper end above the intake of the pump assembly for flowing well fluid from below the packer out the riser tube and down to the intake of the pump assembly.

10. The apparatus according to claim 9, wherein the pump assembly comprises a plurality of centrifugal pump stages, and wherein the conduit leads to the packer from an intermediate one of the stages between lower and upper ones of the stages.

11. The apparatus according to claim 9, wherein the pump assembly comprises:

a centrifugal lower pump having at least one pump stage;

a centrifugal upper pump mounted in tandem with the lower pump and having a plurality of pump stages in excess of the lower pump; and wherein the conduit extends from an upper end portion of the lower pump for diverting a portion of the well fluid flowing through the lower and upper pumps.

12. The apparatus according to claim 9, wherein the packer comprises an inflatable elastomeric element, and wherein the well fluid flowing from the conduit causes the elastomeric element to inflate.

13. The apparatus according to claim 9, wherein the packer comprises:

a central body; and an elastomeric hose wrapped around the body a plurality of turns, the hose being in fluid communication with the conduit and being radially expansible.

14. The apparatus according to claim 9, wherein the packer comprises:

a central body;

an annular elastomeric bladder surrounding the body; and wherein an interior of the bladder is in fluid communication with the conduit.

15. The apparatus according to claim 9, wherein the pump assembly comprises:

a pump;

an electrical motor suspended below and operatively connected with the pump for driving the pump; and wherein the packer is located between the motor and the pump.

16. A method for pumping a well, comprising:

(a) mounting a packer to a submersible pump assembly and lowering the packer and the pump assembly together into the well;

(b) providing a communication path through the packer to an intake of the pump assembly above the packer;

(c) operating the pump assembly to cause well fluid to flow through the communication path and the intake of the pump assembly to the surface; and (d) diverting a portion of the well fluid flowing through the submersible pump assembly to the packer, and moving the packer to an expanded position in sealing engagement with casing in the well in response to fluid pressure created by the pump assembly.

17. The method according to claim 16, wherein step (b) comprises:

extending the communication path to a point above the intake of the pump assembly.

18. The method according to claim 16, wherein step (b) comprises:

providing the packer with a bypass passage and a riser tube that extends upward above the intake of the pump assembly; and step (c) comprises flowing the well fluid from below the packer through the bypass passage, up the riser, and down to the intake.

19. A method for pumping a well, comprising:

(a) mounting a packer to a submersible pump assembly and lowering the packer and the pump assembly together into the well;

(b) operating the pump assembly to cause well fluid to flow through the pump assembly to the surface;

(c) diverting a portion of the well fluid flowing through the submersible pump assembly to the packer, and moving the packer to an expanded position in sealing engagement with casing in the well in response to fluid pressure created by the pump assembly; wherein:

step (a) comprises providing the pump assembly with a centrifugal pump having a plurality of stages;

step (b) comprises increasing the pressure of the well fluid flowing through the pump at each of the stages from an intake pressure to a discharge pressure; and step (c) comprises diverting the well fluid from a point in the pump that is above the intake pressure and below the discharge pressure.

* * * * *